United States Patent [19]

Marker

[11] 4,188,045

[45] Feb. 12, 1980

[54] SAFETY SKI BINDING

[76] Inventor: Hannes Marker, Hauptstrasse 51-53, 81 Garmisch-Partenkirchen, Fed. Rep. of Germany

[21] Appl. No.: 918,452

[22] Filed: Jun. 23, 1978

[30] Foreign Application Priority Data

Jul. 14, 1977 [DE] Fed. Rep. of Germany ..... 2731897

[51] Int. Cl.[2] ..... A63C 9/08

[52] U.S. Cl. ..... 280/614; 280/618; 280/637

[58] Field of Search ..... 280/614, 618, 637, 617

[56] References Cited

U.S. PATENT DOCUMENTS 3,893,682 7/1975 Weinstein et al. ..... 280/637
3,924,866 12/1975 Schweizer ..... 280/637

FOREIGN PATENT DOCUMENTS 1578860 12/1970 Fed. Rep. of Germany ..... 280/618
2418577 10/1975 Fed. Rep. of Germany ..... 280/618

*Primary Examiner*—Joseph F. Peters, Jr.
*Assistant Examiner*—Milton L. Smith
*Attorney, Agent, or Firm*—Fleit & Jacobson

[57] ABSTRACT

A baseplate is mounted on the upper surface of the ski adjacent to the heel of the skiing boot and extends normally in the longitudinal direction of the ski and is rotatable on a vertical axis against a preferably adjustable resistance. A boot carrier is hinged to the baseplate at the forward end of the latter and holds the skiing boot so that the latter is only arbitrarily detachable. The rear end of the boot carrier is lifted from the baseplate against a preferably adjustable resistance. The boot carrier comprises a frame and extends across the baseplate adjacent to the skiing boot. The forward end member of the frame constitutes a hinge pin, which is rotatably mounted on the baseplate. The rear ends of the baseplate and boot carrier are connected by a spring-loaded tension cable and winder assembly.

7 Claims, 2 Drawing Figures

SAFETY SKI BINDING

Figure 1:
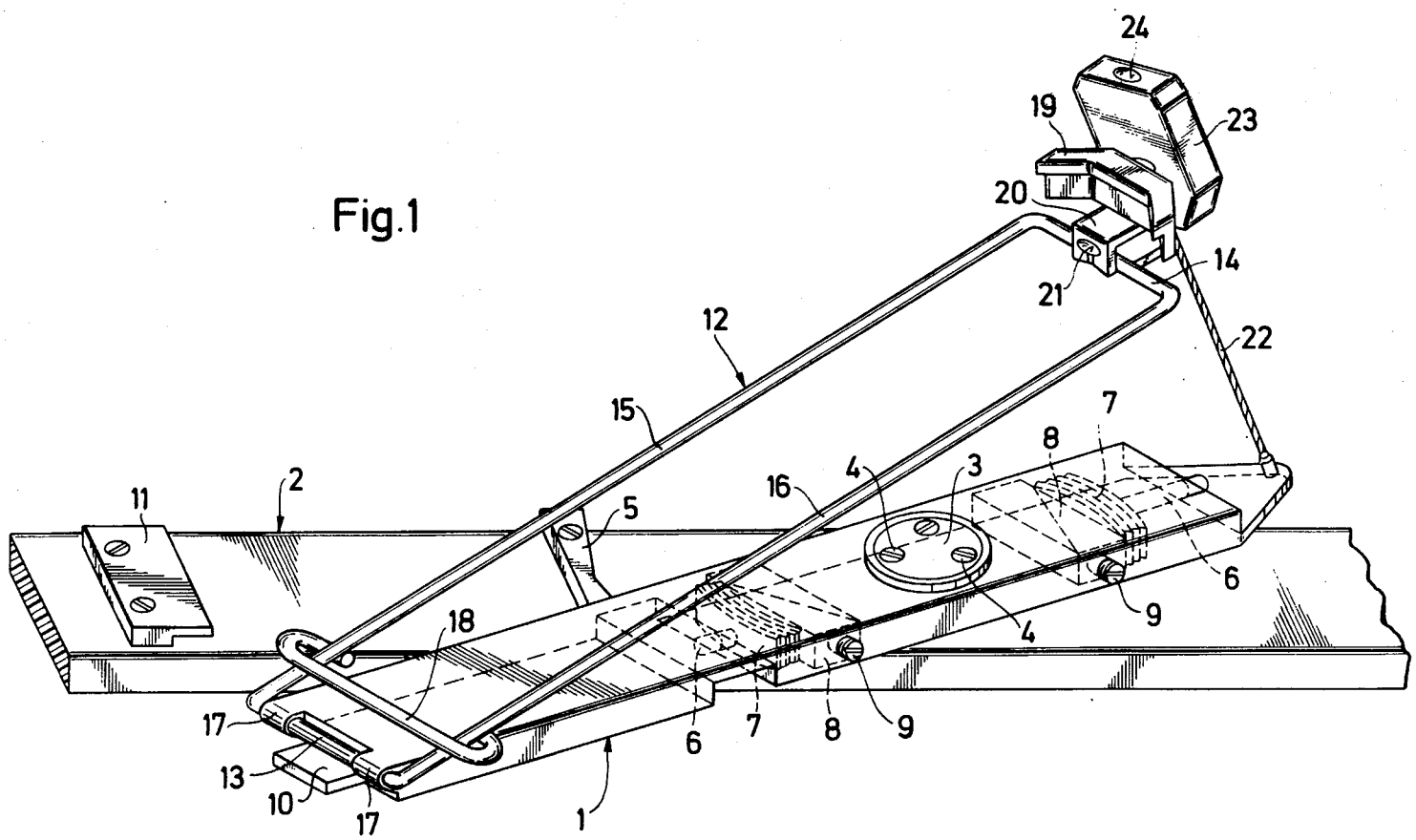

This invention relates to a safety ski binding comprising a baseplate, which is mounted on the upper surface of the ski adjacent to the heel of the skiing boot and extends normally in the longitudinal direction of the ski and is rotatable on a vertical axis against a preferably adjustable resistance, and a boot carrier, which is hinged to the baseplate at the forward end of the latter and holds the skiing boot so that the latter is only arbitrarily detachable, whereas the rear end of said boot carrier is adapted to be lifted from the baseplate against a preferably adjustable resistance.

Such safety ski bindings are known, e.g., from Opened German Specification No. 1,578,860. Reference to that paper is made regarding the specific properties and mode of operation of such safety ski bindings. A ski provided with such ski binding cannot completely separate from the skiing boot and skier so that special means for holding back the ski, such as retaining straps or ski brakes, are not required. Where retaining straps are used, a skier may injure himself as a result of a fall. Such injury is avoided to a large extent where ski bindings of the type described first hereinbefore are employed. Besides, these ski bindings virtually preclude a risk of injury to other persons by a ski which is provided with a ski brake and moves away from the skier after a fall. An additional advantage afforded by the safety ski bindings of the type described resides in that they are suitable for downhill and cross-country skiing and there is no need for complicated manipulations or for an attachment of additional parts for a change from one kind of skiing to the other.

On the other hand it has been found in practice that the known safety ski bindings of the kind discussed still have several disadvantages, by which their utility is considerably reduced. For instance, they have a fairly large overall height because the boot carrier lies on the baseplate. The large overall height adversely affects the control of the ski. During cross-country skiing, the boot carrier is freely movable relative to the baseplate so that it is difficult or even impossible for the skier to change the direction, e.g., by a kick turn.

It is an object of the invention so to improve a safety ski binding of the type described hereinbefore that the disadvantages which have been mentioned are eliminated and the skier is more effectively protected against an injury.

In a safety ski binding of the type described first hereinbefore this object is accomplished according to the invention in that the boot carrier comprises a frame and extends across the baseplate adjacent to the skiing boot, the forward end member of the frame constitutes a horizontal hinge pin, which is rotatably mounted on the baseplate, and the rear ends of the baseplate and boot carrier are connected by a spring-loaded cable and winder assembly.

The provision of a framelike boot carrier permits of a small overall height. During cross-country skiing, the spring-loaded cable and winder assembly presents a sufficiently large resistance to a lifting of the boot carrier so that a better control of the ski is enabled, which when unloaded, e.g., when lifted, is held parallel to the sole of the boot. After a release in case of a forward fall during downhill skiing, the cable and winder assembly also moves the boot carrier and the baseplate toward each other so that the ski cannot freely beat forwardly so as to injure the skier.

According to a preferred feature of the invention, the cable extends through the rear end of the baseplate and is secured to the surface of the ski. This arrangement ensures an automatic return of the baseplate even after a release in case of a twisting fall whereas virtually no additional expenditure is involved.

A compact safety ski binding will be obtained if the cable drum is mounted on the boot carrier. On the other hand, an embodiment in which the cable drum is mounted on the upper surface of the ski behind the baseplate may be particularly suitable for cross-country skiing.

According to a preferred feature of the invention, a compact ski binding will be obtained if the baseplate accommodates two detent mechanisms, which are known per se and one of which serves to releasably lock the baseplate to the ski and the other to releasably lock the boot carrier to the baseplate. In that case it will be particularly desirable to provide the two detent mechanisms on opposite sides of the pivotal axis of the baseplate.

Figure 2:
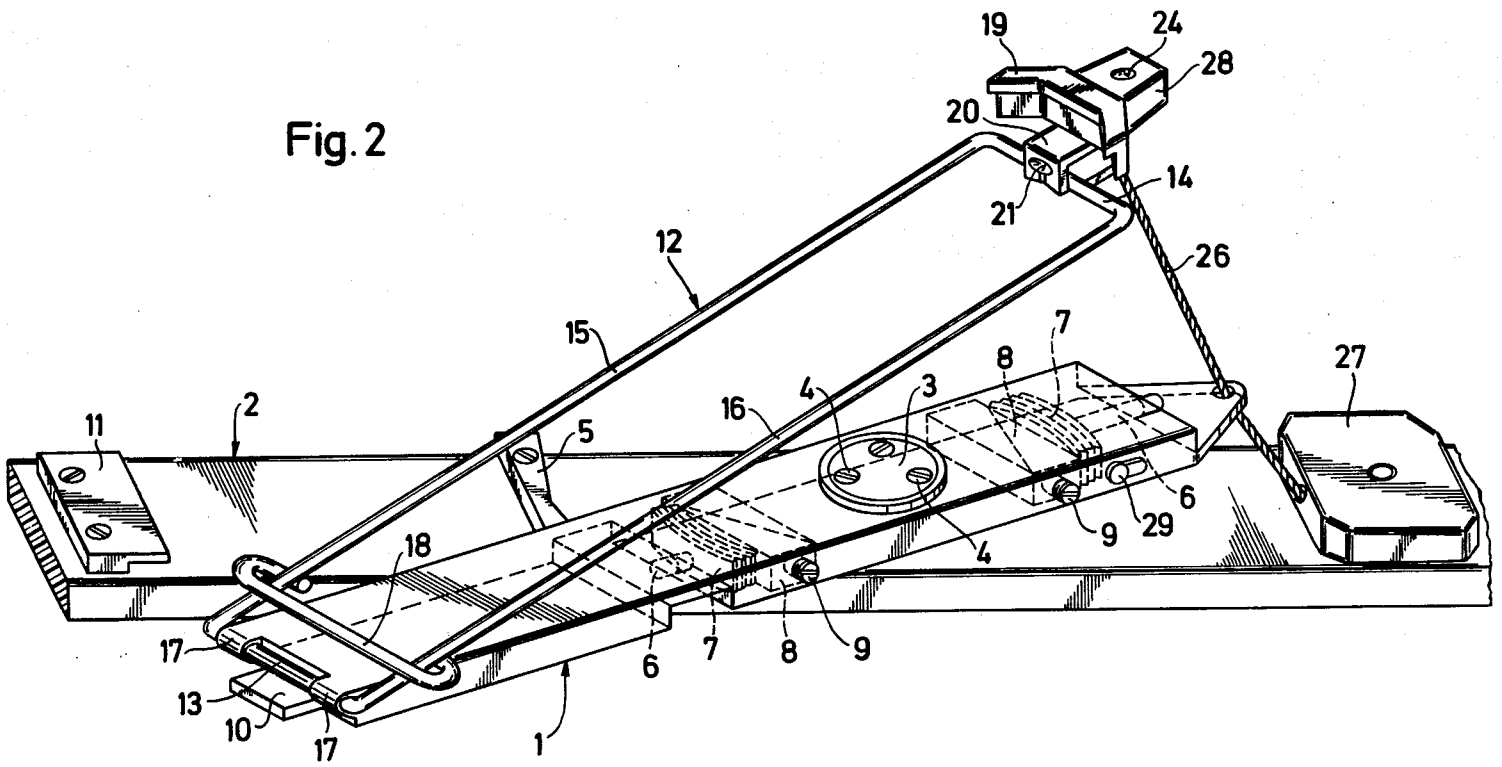

Two embodiments of the safety ski binding according to the invention will now be described more fully and by way of example on the accompanying drawings, in which FIGS. 1 and 2 are perspective views showing one embodiment each at the time of a combined release.

The safety ski binding shown in FIG. 1 comprises a baseplate 1, which is pivoted to the surface of a ski 2. The pivot consists of a disc 3, which is secured to the ski by screws 4 and has an outer rim, which is of reduced thickness and prevents a lifting of the baseplate from the ski. The baseplate extends normally in the longitudinal direction of the ski and is resiliently locked in this position by a spring-loaded detent mechanism. That mechanism comprises, e.g., a bar 5, which is secured to the ski and formed with a detent recess, and a detent pin 6, which has a rounded free end and is urged into the detent recess by a set of leaf springs 7, which are accommodated in the baseplate. An abutment for the leaf springs consists of a wedge 8, which is displaceable by an adjusting screw 9 to vary the force required for a release. The baseplate 1 is provided at its forward end with an offset lug 10, which normally extends under a holding-down member 11, which is mounted on the ski 2. In this way the lug 10 prevents a lifting of the forward end of the baseplate from the ski when the ski binding is loaded at its rear.

A boot carrier comprises a frame 12, which has two end members 13, 14 and two longer side members 15, 16. The inside width of the frame exceeds the width of the baseplate 1 adjacent to the skiing boot. The forward end member 13 of the frame consitutes a hinge pin and is rotatably mounted in two bearing eyes 17 secured to the baseplate.

The boot carrier frame 12 is provided with a U-shaped forward soleholder 18, which serves to clamp down the forward end of the sole of a skiing boot so that the latter is held on the boot carrier. That forward soleholder may be adjustable along the side members 15, 16 of the frame for adaptation to soles having different lengths. Such an adjustable mounting of the forward soleholder is not shown because it is known. The boot carrier frame also carries a rear soleholder 19 for holding down the rear end of the sole. That rear soleholder is pivoted to a retaining member 20, which is secured to the boot carrier frame. As the rear soleholder is only arbitrarily pivotally movable relative to the retaining member 20, a skiing boot held on the boot carrier cannot arbitrarily detach from the binding. The retaining member 20 has a detent recess 21, which belongs to a second spring-loaded detent mechanism. As this detent mechanism is designed like the first, similar parts are designated with the same reference characters. The second detent mechanism resiliently locks the boot carrier frame 12 against lifting from the baseplate 1.

According to a feature of the invention, a spring-loaded cable and winder assembly is provided, which connects the rear ends of the baseplate 1 and of the boot carrier frame 12. That cable and winder assembly is of usual type and for this reason is not described and shown in detail. A cable 22 is wound on a drum, which is accommodated in a housing 23 and biased by a spiral spring tending to wind up the cable. The free end of the cable is secured to the baseplate. The housing 23 is connected to the rear soleholder 19 and serves as a handle for an arbitrary actuation of the rear soleholder. The housing 23 has a recess 24, which can receive the point of a ski pole when the same is used in known manner to open the binding.

When the rear detent mechanism has been arbitrarily or inadvertently released, the cable and winder assembly tends to hold the boot carrier frame 12 in its lower position. This results in the advantages which have been described hereinbefore. Because the boot carrier frame normally lies in the same plane as the baseplate, the present binding does not exceed the conventional plate-type bindings in overall height. The two detent mechanisms are released when the set spring force is overcome. The present safety ski binding may be provided with other known detent mechanisms in which the resistance against a lateral release movement varies in dependence on a rearwardly acting load in such a manner that the resistance against a lateral release movement decreases as the rearwardly directed load increases. Low-friction strips may be provided in known manner between the baseplate and the upper surface of the ski in order to provide for a reduced friction between these parts.

The embodiment shown in FIG. 2 is similar to that of FIG. 1 and the same reference characters are used for like parts.

The main difference resides in that the cable 26 extends through the rear end of the baseplate 1 from the boot carrier frame 12 to the ski 2. The free end of the cable 26 is secured to the boot carrier frame 12 and a housing 27, which corresponds to the housing 23, is secured to the upper surface of the ski 1. Because the cable is threaded through the rear end of the baseplate, the latter will be automatically returned also after a release caused by a twisting fall.

In this embodiment the rear soleholder 19 has for its actuation a handle 28 formed with a recess 24 for receiving the point of the ski pole. An actuating lever 29 is laterally mounted on the baseplate 1 at the rear end thereof and serves to disengage the rear detent mechanism for cross-country skiing. This eliminates the need for a complicated and time-consuming disengagement of this detent mechanism by means of the adjusting screw 9.

What is claimed is:

1. A safety ski binding comprising a baseplate, which is mountable on an upper surface of a ski adjacent to a heel of a skiing boot to extend normally in the longitudinal direction of the ski; means for mounting the baseplate on the upper surface so that the baseplate is rotatable on a vertical axis; a first adjustable resistance for opposing rotation of the baseplate; and a boot carrier, which is hinged to the baseplate at the forward end of the latter and holds a skiing boot so that the latter is only arbitrarily detachable; a second adjustable resistance for opposing lifting of the rear end of said boot carrier from the baseplate, the boot carrier comprising a frame that extends across the baseplate adjacent to the skiing boot, a forward end member of the frame constituting a horizontal hinge pin, which is rotatably mounted on the baseplate; and a spring-loaded cable and winder assembly for connecting rear ends of the baseplate and boot carrier.

2. A safety ski binding according to claim 1, characterized in that a cable of the spring-loaded cable and winder assembly extends through the rear end of the baseplate and is secured to the surface of the ski.

3. A safety ski binding according to claim 1, characterized in that a cable drum of the spring-loaded cable and winder assembly is mounted on the boot carrier.

4. A safety ski binding according to claim 1 or 2, characterized in that a cable drum of the spring-loaded cable and winder assembly is mounted on the upper surface of the ski and spaced from the baseplate.

5. A safety ski binding according to any of claims 1, 2 or 3, characterized in that the baseplate accommodates two detent mechanisms, one of said detent mechanisms being said first adjustable resistance to releasably lock the baseplate to the ski and the other being said second adjustable resistance to releasably lock the boot carrier to the baseplate.

6. A safety ski binding according to claim 5, characterized in that the two detent mechanisms are disposed on opposite sides of the pivotal axis of the baseplate.

7. A safety ski binding according to claim 5, wherein the other of said two detent mechanisms includes means for disengaging the mechanism and for holding the mechanism in a disengaged position.

* * * * *